US005145185A

United States Patent [19]

Yu et al.

[11] Patent Number: 5,145,185

[45] Date of Patent: Sep. 8, 1992

[54] BOARD GAME BOX

[76] Inventors: Wan-Chuan Yu, No. 6-3, Kuan Hou 1st St., Tao Yuan; Jung-Chi Cheng, No. 46, Lane 214, Sec. 1, Yen Ping Rd., Hsin Chu, both of Taiwan

[21] Appl. No.: 748,018

[22] Filed: Aug. 21, 1991

[51] Int. Cl.[5] ..... A63F 3/00; B65D 85/00

[52] U.S. Cl. ..... 273/287; 206/315.1

[58] Field of Search ..... 273/282, 284, 285, 287, 273/260; 206/315.1

[56] References Cited

U.S. PATENT DOCUMENTS 4,811,954 3/1989 Hemmann ..... 273/284

OTHER PUBLICATIONS

Popular Mechanics, "Flip Over Chest Set", Dec. 1962, vol. 118, No. 6, pp. 126–129.

Mechanics Illustrated, "How to Make a Backgammon Board", Aug. 1973, pp. 80–81.

The Hecht Co. advertizement, Washington Post, Jun. 6, 1975, p. B10.

*Primary Examiner*—Benjamin H. Layno

*Attorney, Agent, or Firm*—Fleit, Jacobson, Cohn, Price, Holman & Stern

[57] ABSTRACT

A board game box comprising two base frames made from a plastic material through the process of injection molding and pivotably connected with each other by hinges, said base frames each having an opening at the middle, a groove around said opening and a plurality of projecting strips transversely projecting in said opening at one side above said groove, two veneered panels respectively fastened in said groove and retained in place by said projecting strips, two lining sheets respectively glued to the surface of said two veneered panels, locking devices fastened in said base frames for locking them into a closed position, and a handle attached to either of said base frames for comfortable and positive grip. Each base frame has two locating grooves at two opposite locations for fastening a small storage case for keeping the pieces for a board game.

3 Claims, 4 Drawing Sheets

BOARD GAME BOX

BACKGROUND OF THE INVENTION

The present invention relates to board game box and relates more particularly to a board game box for holding a board game set, which can be made through mass production process to reduce the manufacturing cost.

According to conventional manufacturing process, a board game box is made through much labor effort. FIG. 1 illustrates a backgammon box made according to the known manufacturing process. In making such a backgammon box, sheet bars 91 are firstly connected into a box body 90 through adhesive joint then, the box body thus obtained is externally covered with a layer of ornamental leather 91, and then, a layer of lining cloth 93 is covered over the inner wall surface of the box body and, finally, compartments 94 are attached to the box body at the inside. Because much labor effort is required, constant quality is difficult to maintain and, mass production is difficult to achieve. Further, the structural strength of the backgammon box is weak and the whole assembly may be caused to deform or collapse easily by any outside impact force because the main structure of which is built up through adhesive joint.

SUMMARY OF THE INVENTION

It is one object of the present invention to provide a board game box which can be made through mass production process to reduce the cost.

It is another object of the present invention to provide a board game box which is strong and durable in use.

According to one aspect of the present invention, there is provided a board game box which is generally comprised of two pivoted base frames, two veneered panels, two lining sheets and locking devices and handle, wherein said base frames are respectively made from a plastic material through the process of injection molding pivotably connected with each other by hinges, each of which having an opening at the middle, a groove around said opening for mounting either of said veneered panels over said opening, and a plurality of projecting strips for retaining either of said veneered panels in said groove.

According to another aspect of the present invention, the veneered panels each is made from a rectangular board overlapped with a layer of sponge and covered with a veneer, and the veneered panels can be conveniently firmly fastened in the base frames with the outer surface thereof slightly curves outwards over the outer surface of the base frames. The veneered panels provide a good elastic resilient property to support the board game box stably on a flat surface.

According to still another aspect of the present invention, the two base frames each has two locating grooves at two opposite locations for fastening a small storage case for keeping the pieces for a board game conveniently through tongue-and-groove joint.

DETAILED DESCRIPTION OF THE PREFERRED EMBODIMENTS

Figure 1:
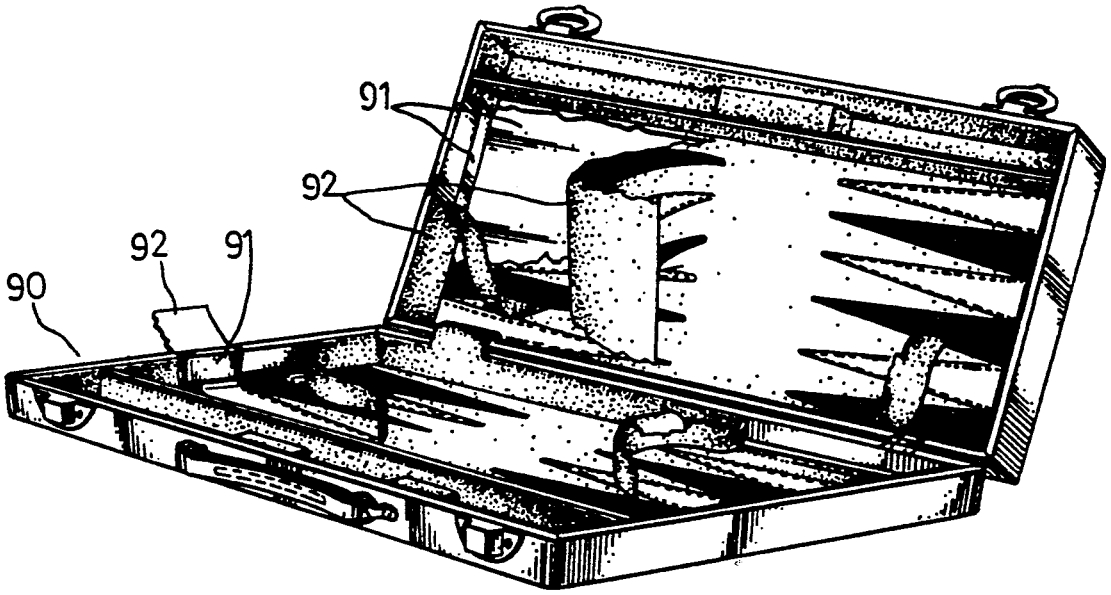
FIG. 1 illustrates a backgammon box constructed according to the prior art.
Figure 2:
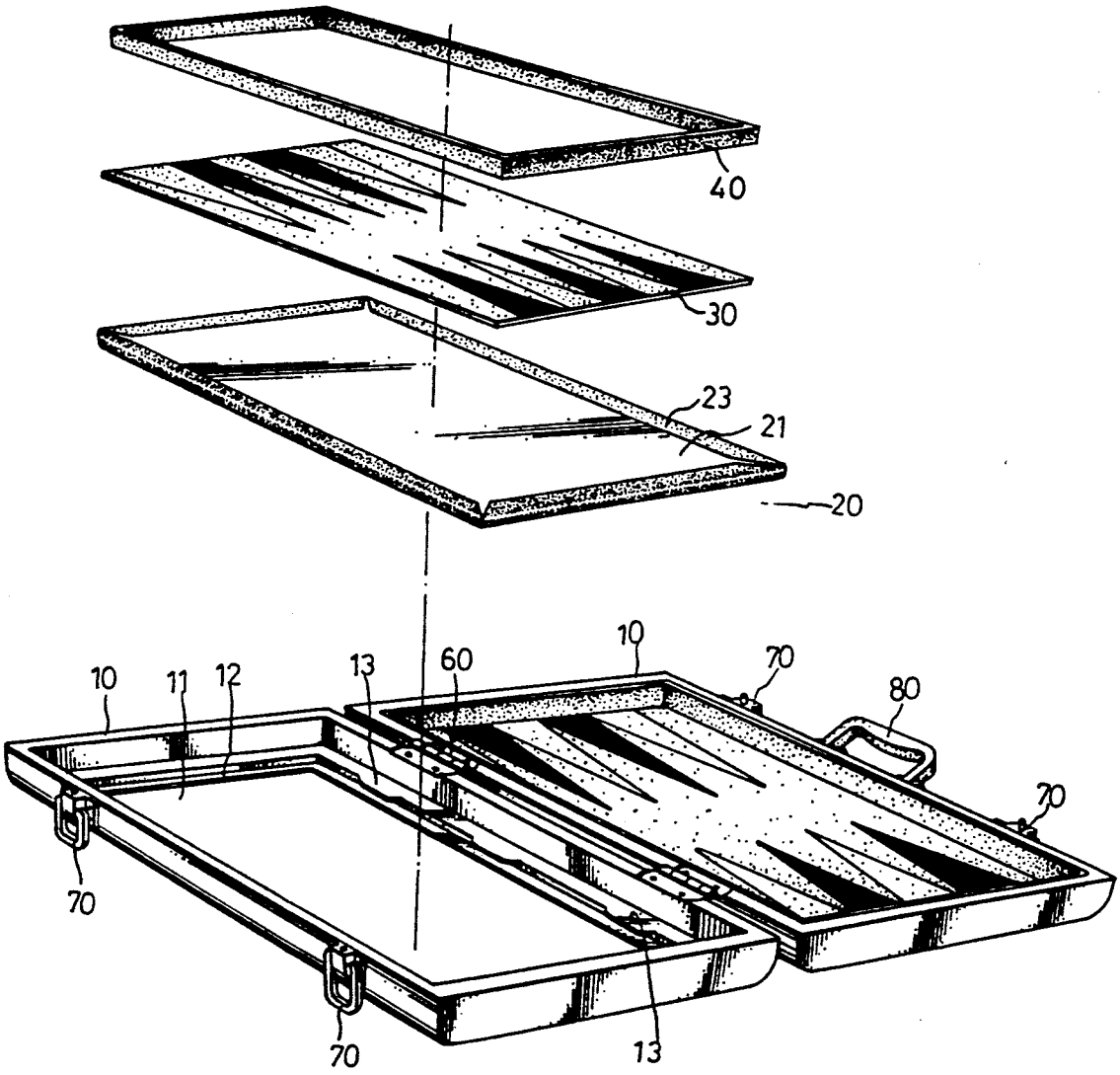
FIG. 2 is an exploded perspective view of a first embodiment of the present invention.
Figure 3:
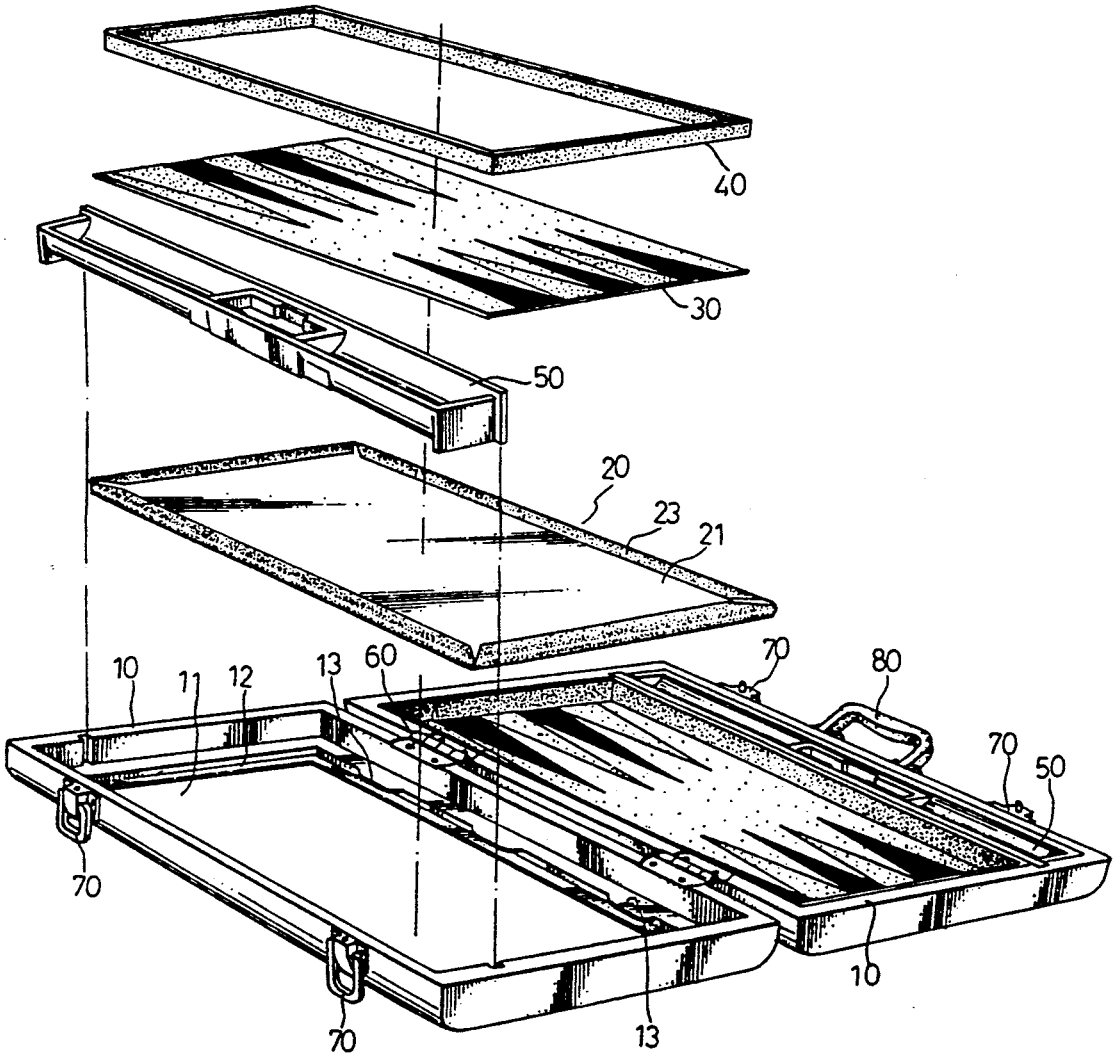
FIG. 3 is an exploded perspective view of a second embodiment of the present invention.

Referring to FIG. 2, a board game box in accordance with the present invention is generally comprised of two plastic base frames 10 respectively made through the process of injection molding, two veneered panels 20, two lining sheets 30 and two pieces of lining cloth 40. In an alternate form of the present invention, two referring to FIG. 3, small storage cases 50 are used.

Each plastic base frame 10 defines therein an opening 11 and has a groove 12 around said opening 11 for mounting either veneered panel 20 and a plurality of projecting strips 13 transversely projecting inwards at an inner side. When either veneered panel 20 fastened in the groove 12 above the opening 11, it is retained in place by the projecting strips 13. Once a veneered panel 20 is fastened in the groove 12 above the opening 11, a lining sheet 30 and a piece of lining cloth 40 are covered thereon in proper order through adhesive joint. Further, referring to FIG. 3, two locating grooves 14 may be made on each plastic base frame 10 on the inner wall surface thereof at two opposite locations for mounting either storage case 50 which is provided for keeping the pieces for a board game.

Figure 4:
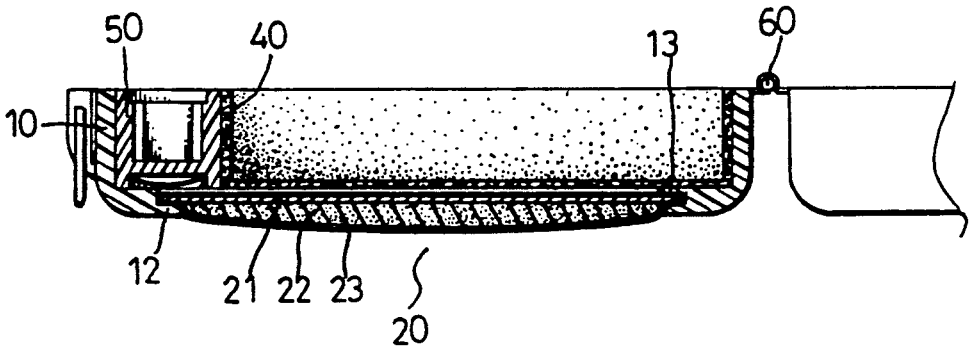
FIG. 4 is a partly sectional view of the second embodiment of the present invention.

Referring to FIG. 4, each veneered panel 20 is made in size tightly fitting the space defined within the groove 12. Therefore, either veneered panel 20 is inserted in the groove 12 on either base frame 10, it is immediately retained in place. Each veneered panel 20 is made from a rectangular board 21 overlapped with a layer of sponge 22 and then covered with a veneer 23. After finishing, each veneered panel 20 has an outer surface slightly curves outwards. Therefore, when each veneered panel 20 is fastened in the groove 12 in each base frame 10, the outer surface of the veneered panel 20 sightly curves outwards over the outer surface of the base frame 10. Because each veneered panel 20 has a sponge filler, it has elastic and anti-skid properties.

As soon as the two veneered panels 20, the two lining sheets 30 and the two pieces of lining cloth 40 are respectively fastened in the two base frames 10, the two base frames 10 are connected by hinges 60, and then, locking devices 70 and handle 80 are respectively fastened to the two base frames 10 at suitable locations. Because the base frames 10 are made from a plastic material through the process of injection molding, fastening holes are respectively formed therein at the predetermined locations for fastening the locking devices 70 and the handle 80 once they are made. Through the process of injection molding, the whole structure of the base frames 10 is stronger in use.

What is claimed is:

1. A board game box, comprising two base frames made from a plastic material through the process of injection molding and pivotably connected with each other by hinges, two veneered panels respectively fastened in said two pivoted base frames, two lining sheets respectively glued to the surface of said two veneered panels, and locking devices for locking said two pivoted base frames in a closed position, wherein said two pivoted base frames each has an opening at the middle, a groove around said opening on which one of said veneered panels is supported, and a plurality of projecting strips transversely projecting inwards from an inner side of the respective frame over the respective veneered panel to secure said veneered panel on said groove.

2. A board game box, comprising two base frames made from a plastic material through the process of injection molding and pivotably connected with each other by hinges, two veneered panels respectively fastened in said two pivoted base frames, two lining sheets respectively glued to the surface of said two veneered panels, and locking devices for locking said two pivoted base frames in a closed position, wherein said two pivoted base frames each has an opening at the middle, a groove around said opening for mounting either of said veneered panel, and a plurality of projecting strips transversely projecting inwards at an inner side to secure either of said veneered panel in said groove, wherein either of said two base frames each has two locating grooves on the inner wall surface therein at two opposite locations for fastening a small storage case.

3. A board game box, comprising two base frames made from a plastic material through the process of injection molding and pivotably connected with each other by hinges, two veneered panels respectively fastened in said two pivoted base frames, two lining sheets respectively glued to the surface of said two veneered panels, and locking devices for locking said two pivoted base frames in a closed position, wherein said two pivoted base frames each has an opening at the middle, a groove around said opening for mounting either of said veneered panel, and a plurality of projecting strips transversely projecting inwards at an inner side to secure either of said veneered panel in said groove, wherein said two veneered panels each is made from a rectangular board overlapped with a layer of sponge and covered with a veneer, and wherein said two veneered panels each having an outer surface slightly curves outwards over the outer surface of either of said base frames.

* * * * *